United States Patent [19]

Meyer

[11] Patent Number: 4,665,854

[45] Date of Patent: May 19, 1987

[54] SAIL RIG

[75] Inventor: Urs P. Meyer, Pfaffhausen, Switzerland

[73] Assignee: Hannspeter Grieskamp, Ebmatingen, Switzerland

[21] Appl. No.: 713,403

[22] PCT Filed: Jun. 25, 1984

[86] PCT No.: PCT/CH84/00104

§ 371 Date: Mar. 1, 1985

§ 102(e) Date: Mar. 1, 1985

[87] PCT Pub. No.: WO85/00333

PCT Pub. Date: Jan. 31, 1985

[30] Foreign Application Priority Data

Jul. 6, 1983 [CH] Switzerland ..... 369683

[51] Int. Cl.[4] ..... B63B 35/82

[52] U.S. Cl. ..... 114/39; 114/90; 114/102; 114/97

[58] Field of Search ..... 114/102, 103, 90, 91, 114/39, 39.1, 39.2, 97

[56] References Cited

U.S. PATENT DOCUMENTS

| | | | |
|---|---|---|---|
| 4,186,680 | 2/1980 | Harpole | 114/103 |
| 4,369,724 | 1/1983 | Weiss | 114/103 X |
| 4,501,214 | 2/1985 | Meyer | 114/90 |

FOREIGN PATENT DOCUMENTS

| | | | |
|---|---|---|---|
| 2802471 | 7/1978 | Fed. Rep. of Germany | 114/39.2 |
| 2951209 | 6/1981 | Fed. Rep. of Germany | 114/102 |
| 3024954 | 1/1982 | Fed. Rep. of Germany | 114/103 |
| 3047410 | 7/1982 | Fed. Rep. of Germany | 114/39.2 |

*Primary Examiner*—Joseph F. Peters, Jr.
*Assistant Examiner*—Paul E. Salmon
*Attorney, Agent, or Firm*—Werner W. Kleeman

[57] ABSTRACT

The sail rig comprises a quadrangular sail. A mast sleeve is arranged through the sail area from head to the foot and a flexible mast of flat cross section is inserted therein. A wishbone or a single-boom is connected at the fore to the luff clew and at the rear to the aft leech clew. Owing to the curvature or camber of the sail, its periphery is subject to higher tension than the remaining surface. Therefore, even after rigging up, the sail will not only curve horizontally, but also vertically. When exposed to wind, the sail will form a harmonic compound shape having its concave side to windward. The mast connected to the sail by the mast sleeve bends in the same direction as the sail. The tension around the periphery produces a triangulation effect in conjunction with the mast, similar to that of stays, thereby preventing the mast head from deflecting to leeward. The tension forces of the sail acting upon the mast are balanced and negligible. It is thus possible to build a lighter and more flexible mast. The mastless leading edge offers a minimum of air resistance and enhances laminar airflow. A substantial increase in forward thrust and a reduction of side forces are obtained. This sail rig permits a smaller angle of incidence to the wind, offering more upwind pointing and speed potential. The bending of the mast head to windward under wind pressure means that airflow spillage cannot occur at the head of the rig.

12 Claims, 6 Drawing Figures

SAIL RIG

BACKGROUND OF THE INVENTION

The present invention broadly relates to a sail-rig with a mast for sail-craft, and more specifically, to a sail rig for sailboards, with which an unstayed, non-braced mast is connected by means of a fully-articulated, rotating and pivoting joint.

Modern sail-craft are practically always equipped with a triangular main sail connected along its luff to as stiff as possible a mast, and whose clew is attached to the rear end of a boom, which is held at its forward end by the mast. Many small sail-craft, such as dinghies, Lasers and sailboards have neither jib sails nor mast stays. The masts of these so-called cat-type rigs can be subject to extreme forces. Even while setting the sail, the requisite preloading causes the mast to deflect considerably and under the influence of wind forces the sail's tensile force causes increased mast deflection. On account of this, the sail shape changes unfavorably, thereby reducing desirable forward thrust while unwanted side forces increase.

In order to keep the undesirable mast deformation within acceptable limits, it has been common practice to use masts with large cross-sections. A thick mast along the leading edge affects aerodynamic efficiency quite unfavorably, not only by slowing down the air flow but also by creating turbulence, which in turn destroys the suction on the leeward sail side, which is supposed to provide most of the thrust. It is known that in such a case aerodynamic drag increases by more than 50% and lift is reduced by about 20%. This means that forward thrust is dramatically reduced.

In order to avoid these disadvantages there has been a move towards thinner masts, with the attendant disadvantage of more undesirable mast deflection. Where large sail-craft re concerned, the problem of this mast deflection under high wind forces is solved with stays and bracing. However, additional aerodynamic drag and turbulence is created by these measures.

The connection between wishbone boom and mast of conventional sailboards represents an enormous local or point stress, which is proven by the fact that most mast breakages usually occur at or near that location. In order to absorb the high leverage forces, unstayed masts need not only a sufficiently thick profile or cross-section but also need to be made of strong materials. As a result, they are aerodynamically inefficient, expensive and heavy.

SUMMARY OF THE INVENTION

Therefore, with the foregoing in mind, it is a primary object of the present invention to provide sail rigs which can produce more forward thrust with less aerodynamic resistance, and which produce thrust at smaller angles of incidence than conventional rigs of similar size under identical wind conditions.

It is a further object of the present invention to provide sail rigs having better handling characteristics, lighter weight and cheaper production costs than heretofore known rigs.

Yet a further significant object of the present invention aims at providing a new and improved construction of a sail rig of the character described which is relatively simple in construction and design, extremely economical to manufacture, highly reliable in operation, not readily subject to breakdown and malfunction and requires a minimum of maintenance and servicing.

Now in order to implement these and still further objects of the invention, which will become more readily apparent as the description proceeds, the sail rig of the present invention is manifested by the features that it comprises a free-standing flexible mast having a cross-section shape, a bending curve, a fully articulated rotating and pivoting joint for connecting the free-standing flexible mast to the sail craft, a sail of essentially polygonal outline and having a sail head, a sail foot, a tack clew, a leech clew and a vertical curvature or camber. The sail contains a region of maximum camber depth and includes an attachment device extending through the region of maximum camber depth and between the sail and the sail foot substantially at a right angle relative to the main wind direction for closely holding the free-standing flexible mast to the sail. The attachment device of the sail envelops the free-standing flexible mast at least partially. The free-standing flexible mast has a unique flexibility ratio due to the cross-section shape and adapts the bending curve at all times to a vertical cruvature or camber of the sail such that the free-standing flexible mast partakes of every motion of the sail. The sail rig further comprises a boom connected at its ends to the tack clew and the leech clew fo providing the necessary horizontal tension in the sail.

By positioning the flat, flexible mast in a mast sleeve diagonally across the sail area through the region of its deepest camber, the aerodynamically disturbing mast can be eliminated from the leading edge, or luff, of the sail. The air can now flow across both sides of the sail surface with hardly any drag or turbulence, thereby producing maximum forward thrust. This is especially the case in the forward third portion of the leeward sail surface, where the greatest share of thrust is produced under laminar airflow conditions, even at very shallow angles of incidence, such as between 10 and 15 degrees.

On account of the 3-dimensional sail cut, the sail not only curves horizontally, but also vertically when rigged or set and under sufficient downhaul and outhaul tension, under the influence of wind. The flexible mast adapts to the vertical or upright sail curvature and has, in conjunction with the fore and aft leech clews, an extremely profile-stabilizing effect. Both the sail as well as the mast have a concave curvature towards the windward side. Fore and aft leeches, both of which are attached to the boom, have an effect similar to that of a built-in stay. The mast top and mast foot both flex towards the luff. This prevents air from spilling out at the sail head. The fact that the mast traversing the sail surface or area may cause a slight ridge across the horizontal sail curvature is of little consequence, because even with an ideal profile shape the airflow becomes turbulent at the point of maximum camber on the leeward side, whereas no negative effect results from this fact on the windward or luff sail side. However, the mast being mounted across the sail prevents the point of maximum camber from shifting aft under high wind conditions and the center of pressure of the sail hardly changes, thus resulting in simpler and more pleasant sailing without the need for constantly altering sail trim and setting in gusty winds.

The configuration of the sail-rig according to the present invention is equipped with a flexible, batten-like mast extending through the sail. The mast has no direct connection with the forward end of the boom, the forces acting upon sail and mast being of totally different nature than in conventional rigs. Not only is less static pretension or preloading needed for the sail and the mast than for a conventional, triangular or Marconi sail rig, but the dynamic forces resulting from wind pressure are drastically reduced, since they act from opposite sides on the central mast, thus cancelling each oher. This is why the mast can be constructed much lighter. A lot of flexibility is even desirable.

Since the sail requires less rigging tension and a somewhat smaller sail area will produce just as much thrust, a further weight reduction is obtained. A symmetrical embodiment of the sail rig with a one-sided boom will be at least 1 to 2 kilograms lighter in weight than standard rigs.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
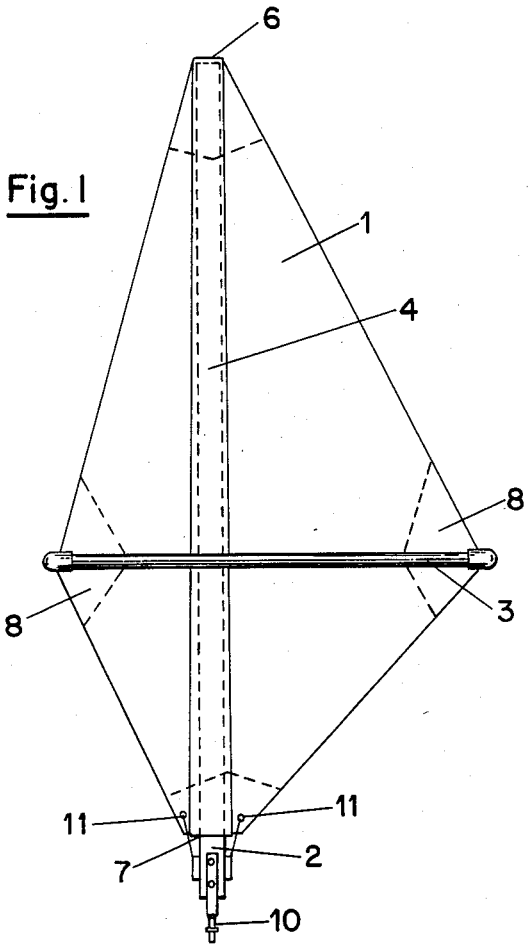
FIG. 1 illustrates an assymetrically cut sail rig with a wishbone-type boom, in side view.

Describing now the drawings, it is to be understood that to simplify the showing thereof only enough of the structure of the sail rig has been illustrated therein as is needed to enable one skilled in the art to readily understand the underlying principles and concepts of this invention. Turning specifically to FIG. 1 of the drawings, the apparatus illustrated therein by way of example and not limitation will be seen to comprise a sail rig for a sailboard. The sail 1 has an asymmetrical, principally quadrilateral, rhomboidal outline with acute-angled corners at both head 6 and foot 7, and with obtuse-angled corners at the clews of both fore and aft leeches 8 and 8', respectively. All four corners are reinforced. At the foot 7 there is an eyelet or grommet 11 allowing the sail 1 to be tightened vertically. Between the head of the sail 1 and the foot 7 a mast sleeve 4 with an open bottom end at the foot 7 is sewn diagonally across the surface or extent of the sail 1. Instead of sewn seams, the mast sleeve 4 could also be attached to the sail 1 by means of bonding or welding. The method of attachment is determined largely by the type of materials employed for the sail 1 and the mast sleeve 4.

A flexible mast 2, is preferably of flat cross-section, said cross-section having a relationship between its major axis parallel to the sail axis and its minor axis of 2 to 1 or more. The front end of a wishbone-type boom 3 is attached to the clew of the angled luff-leech 8. The rear or after end of the wishbone-type boom 3 is attached to the clew of the angled aft-leech 8', thus providing the necessary horizontal sail tension. At the foot of the mast 2, an articulated rotating and pivoting mast foot joint with the standard flexible rubber joint 10 is mounted.

Figure 2:
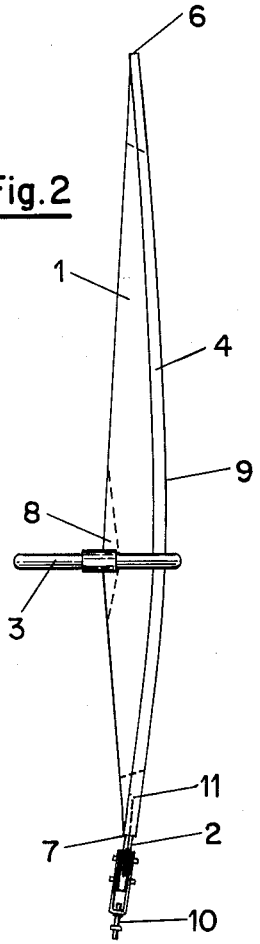
FIG. 2 shows the sail rig according to FIG. 1, as seen from the front.

FIG. 2 illustrates a frontal view of the inventive sail rig. This figure shows the flexible mast 2 to form a concave flex curve towards the windward side in unison with the sail 1, and the angled fore and aft leeches 8 and 8' to function in a manner somewhat similar to that of stays or bracing, thus preventing the mast 2 and the sail 1 from yielding towards the other side, or in other words, from becoming convex towards the windward side.

Figure 3:
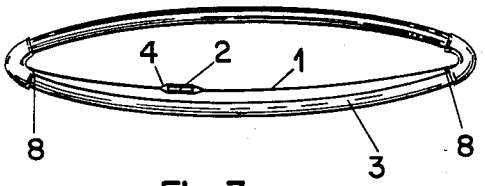
FIG. 3 shows the sail rig according to FIG. 1, in cross-section, at the height of the wishbone-type boom.

FIG. 3 shows a cross-section of the same rig in the region of the wishbone-type boom 3. Fore and aft clews 8 and 8' respectively as well as their connections with the wishbone-type boom 3 can be seen. Furthermore, the horizontal cross-section of the profile of the sail 1, the mast sleeve 4, which hardly produces any air resistance, as well as the flexible, batten-shaped mast 2 inside the mast sleeve 4 are visible. This flexible mast 4 has a flat cross-section whose longer or major cross-sectional axis is at least twice as long as its shorter or minor axis. The flexible mast 4 shown in FIG. 3 has its longer or major axis of the cross-section four times as long as its shorter or minor axis. Depending upon the length of the flexible mast 2, the relationship between the major and minor axes of the cross-section may vary. This is especially the case with masts tapering towards the head. This rig is suited best for normal sailing technique where the same leading edge is always pointing into the wind.

Figure 4:
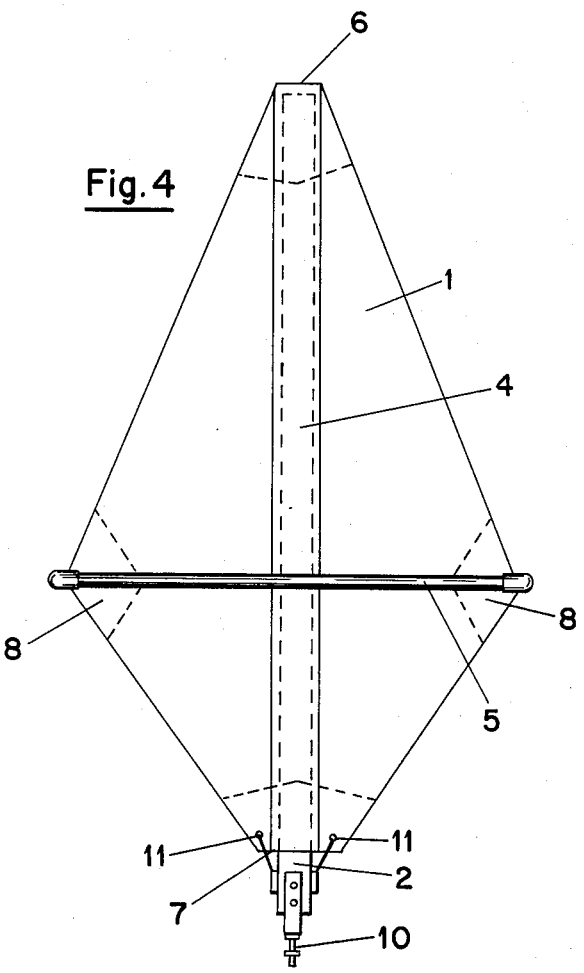
FIG. 4 shows a symmetrically cut sail rig with a single boom on one side of the sail, in side-view.
Figure 5:
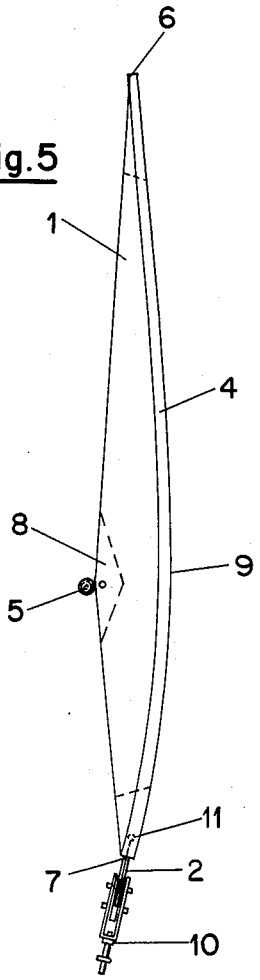
FIG. 5 shows the sail rig as illustrated in FIG. 4, seen from the front.
Figure 6:
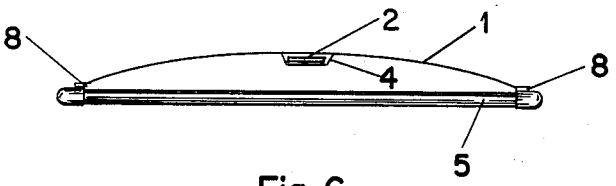
FIG. 6 shows the sail rig as illustrated in FIG. 4, in sectional view at the height of the single boom.

The sail rig shown in FIGS. 4, 5 and 6 differs from the sail rig illustrated in FIGS. 1, 2 and 3 in as much as the sail 1 is of symmetrical cut left and right of the mast 2, and that there is only a single boom or boom spar 5 mounted on the windward sail side. This type of rig is especially suited for fast jibes, because this maneuver can be accomplished without shifting the sail 1 around. Due to the symmetrical sail profile, the sail rig is reversible, which means that either leech can alternately act as leading or trailing edge. This is the case for both tacking and jibing. The windward side of the rig is always the side on which the single boom 5 is located. In this rig version it is preferable for the mast sleeve 4 to be sewn onto the sail 1 on its windward side.

While there are shown and described present preferred embodiments of the invention, it is to be distinctly understood that the invention is not limited thereto, but may be otherwise variously embodied and practiced within the scope of the following claims.

Accordingly, what I claim is:

1. A sail rig for sailcraft subjected to a main wind direction, especially for sailboards, comprising:

a free-standing flexible mast having a cross-section shape and a bending curve;

a fully articulated, rotating and pivoting joint for connecting said free-standing flexible mast to the sailcraft;

a sail having a mastless luff forward and a mastless leech aft;

said sail containing a region of maximum camber depth remote from said mastless luff and said mastless leech;

said sail being of essentially polygonal outline, devoid of edge reinforcing lines at least at said mastless luff and said mastless leech, formed of a single sail cloth and having a sail head, a sail foot, a tack clew, a leech clew and an upright camber;

said sail including an attachment device extending through said region of maximum camber depth remote from said mastless luff and said mastless leech and between said sail head and said sail foot substantially at a right angle relative to the main wind direction for closely holding said free-standing flexible mast to said sail;

said attachment device of said sail enveloping said free-standing flexible mast at least partially;

said free-standing flexible mast having a predetermined flexibility ratio due to said cross-section shape;

said free-standing flexible mast adapting said bending curve at all times to said upright camber of said sail such that said free-standing flexible mast partakes of every motion of said sail; and a boom connected at its ends to said tack clew and said leech clew for providing the necessary horizontal tension in said sail.

2. The sail rig as defined in claim 1, wherein:

said free-standing flexible mast has a cross section with a major axis at least twice as great as a minor axis thereof.

3. The sail rig as defined in claim 1, wherein:

said attachment device of said sail for said free-standing flexible mast comprises a mast sleeve made of flexible material;

said mast sleeve being connected to said sail between said sail head and said sail foot and through said region of maximum sail camber; and said mast sleeve having at at least one of said sail head and said sail foot an opening for selectively inserting and removing said free-standing flexible mast.

4. The sail rig as defined in claim 3, wherein:

said attachment device for said free-standing flexible mast is sewn to said sail.

5. The sail rig as defined in claim 1, wherein:

said sail is of symmetrical outline on both sides of said free-standing flexible mast.

6. The sail rig as defined in claim 1, wherein:

said sail is of assymmetrical outline on both sides of said free-standing flexible mast.

7. The sail rig as defined in claim 1, wherein:

said boom comprises a wishbone-type boom;

said wishbone-type boom having a curved spar on each side of said sail; and the ends of said wishbone-type boom being attached with said tack and leech clews of said mastless luff and leech of said sail.

8. The sail rig as defined in claim 1, wherein:

said boom comprises a single boom spar;

said single boom spar being located on the windward side of said sail;

said sail having a mastless angled luff forward and a mastless angled leech aft;

said mastless angled luff having a tack clew;

said mastless angled leech having a leech clew; and the ends of said single boom spar being connected with said tack clew and said leech clew of said mastless angled luff and said mastless angled leech of said sail.

9. The sail rig as defined in one of the preceding claims, wherein:

said attachment means is structured such that there is a continuous profile cross section where said sail and said free-standing flexible mast meet.

10. The sail rig as defined in claim 1, wherein:

said sail has therewith associated rope lines; and said free-standing flexible mast and said boom being interconnected exclusively by said sail and said associated rope lines.

11. The sail rig as defined in claim 3, wherein:

said attachment device for said mast sleeve is bonded to said sail.

12. The sail rig as defined in claim 3, wherein:

said attachment device for said mast sleeve is welded to said sail.

* * * * *

UNITED STATES PATENT AND TRADEMARK OFFICE

CERTIFICATE OF CORRECTION

PATENT NO. : 4,665,854

DATED : May 19, 1987

INVENTOR(S) : URS P. MEYER

It is certified that error appears in the above-identified patent and that said Letters Patent is hereby corrected as shown below:

Column 1, line 39, please delete "re" and insert --are--

Column 2, line 23, please delete "cruvature" and insert --curvature--

Column 2, line 27, please delete "fo" and insert --for--

Column 3, line 55, please insert --6-- after "head"

Column 4, line 41, after "around" please insert --The sailor can always remain on the same side of the sail 1.--

Column 5, line 35, please delete (in the first instance) "at" after "having".

On The Title Page, delete "[73] Assignee: Hannspeter Grieskamp, Ebmatingen, Switzerland".

Signed and Sealed this

Second Day of February, 1988

*Attest:*

*Attesting Officer*

DONALD J. QUIGG

*Commissioner of Patents and Trademarks*